United States Patent [19]

Martens et al.

[11] Patent Number: 4,734,042

[45] Date of Patent: Mar. 29, 1988

[54] MULTI ROW HIGH DENSITY CONNECTOR

[75] Inventors: John D. Martens, Plano; J. Preston Ammon, Dallas, both of Tex.

[73] Assignee: Augat Inc., Mansfield, Mass.

[21] Appl. No.: 12,587

[22] Filed: Feb. 9, 1987

[51] Int. Cl.[4] ..... H01R 9/09

[52] U.S. Cl. ..... 439/62; 361/413; 439/59; 439/65

[58] Field of Search ..... 361/413, 420, 412, 414; 174/68.5; 339/17 LC, 14 R, 75 MP, 176 MP; 439/59, 60, 61, 62, 65

[56] References Cited

U.S. PATENT DOCUMENTS

| | | | |
|---|---|---|---|
| 4,025,147 | 5/1977 | Arsdale et al. | 339/17 LC X |
| 4,107,760 | 8/1978 | Zimmer | 361/412 X |
| 4,392,700 | 7/1983 | Showman et al. | 339/176 MP X |
| 4,392,705 | 7/1983 | Andrews et al. | 339/75 MP |
| 4,629,271 | 12/1986 | Awano | 339/75 MP |
| 4,631,637 | 12/1986 | Romania et al. | 361/413 |
| 4,639,056 | 1/1987 | Lindeman et al. | 339/17 LC |
| 4,659,155 | 4/1987 | Walkup et al. | 339/14 R |

*Primary Examiner*—R. R. Kucia

*Attorney, Agent, or Firm*—Weingarten, Schurgin, Gagnebin & Hayes

[57] ABSTRACT

A high density connector for connecting to the edge of a printed circuit board uses two different contact terminals, one of which is reversible, and a spacing block to guide the contact terminals into the connector and to maintain close spacing of the contacts on each side of the printed circuit board. The connector housing has openings in the center of the housing to allow for expansion of the housing material and to provide for an optional grounding bus.

12 Claims, 10 Drawing Figures

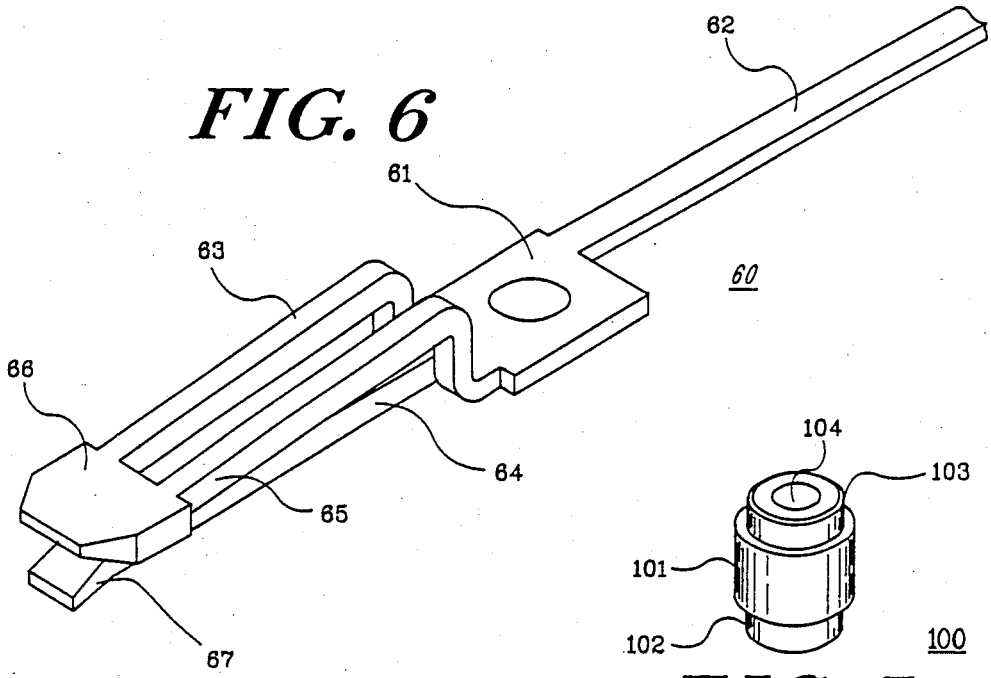
FIG. 6
FIG. 7
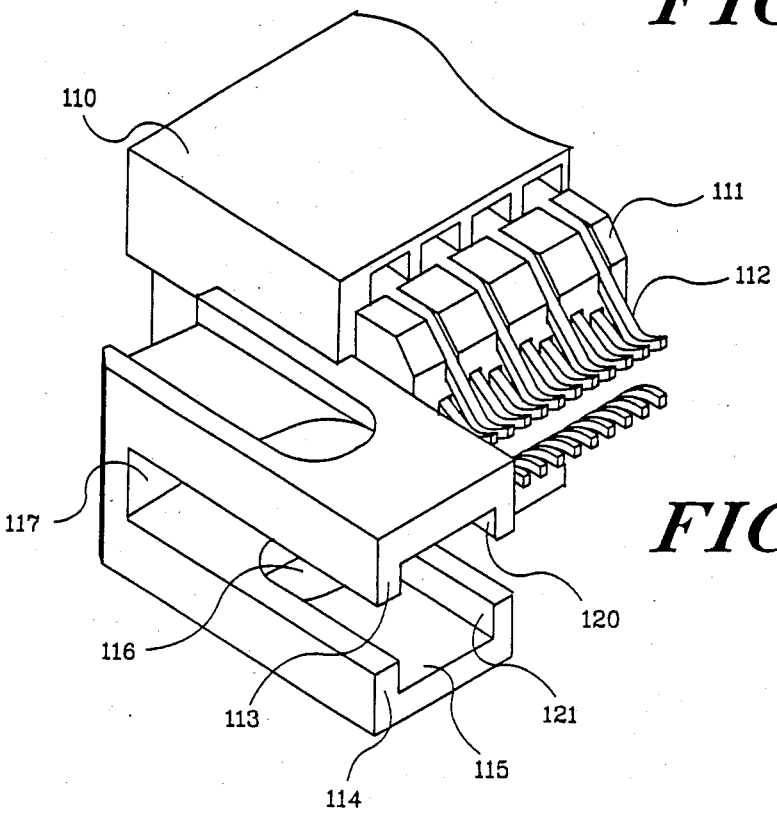
FIG. 8

MULTI ROW HIGH DENSITY CONNECTOR

BACKGROUND OF THE INVENTION

This invention relates to connectors and more particularly to a connector having six or more rows of contacts across the connector, the contacts extending out the bottom of the connector housing and bent to form only two rows of contacts that are secured to opposite surfaces of a printed circuit board.

Multi row connectors are generally on the face of a back panel or circuit board so to provide adequate room for all the contacts of the connector to connect to the circuit pattern on the circuit board. For example, connectors commonly referred to as DIN connectors are multi row connectors that have, for example, three rows of contacts, each contact extending out one side of the connector housing in three rows to mate with three rows of contact holes on the printed circuit board. In this example the contacts are spaced at intervals the same as the contacts in the connector housing.

If the connector is to be connected to the edge of the circuit board with the contacts contacting at least one surface of the circuit board, the contacts may be configured as illustrated in U.S. Pat. No. 4,196,957 wherein the four rows of contacts have tails of different length so that they may be bent to extend to different rows of contact areas on the circuit board. Such a configuration requires a large area on the circuit board to make the required connection for the connector.

Both the connector mounted on the face of the connector and the connector mounted at the edge of the circuit board described above require surface area of the circuit board that could be used for placement of components thereby requiring a larger surface area on the circuit board.

SUMMARY OF THE INVENTION

According to a preferred embodiment of the invention, a multi row connector is utilized to connect to high density connections on the edge of a circuit board. The connector terminals are surface mounted on circuit patterns on two sides of the circuit board.

The connector has a plurality of rows of contacts extending out one side of the connector housing and terminating in two rows. For example, in one embodiment, six rows of terminals extend along the length of the connector, with the ends of the contacts in three rows terminating in a single row of contacts, the contact ends being spaced at intervals one-third the spacing between the contacts in the connector. The other three rows of contacts of the six rows also terminate in a single row spaced apart from the first single row with identical spacing to the first row.

Two differently configured contact types are used, however one contact type is reversed in two different rows to shift the contact ends to provide the desired spacing of the contact ends.

Since the contact ends are spaced apart one-third the distance of the contact spacing in the connector, the ends are very close to each other, and to correctly space the contact ends and maintain proper spacing, two spacing blocks are inserted in the underside of the connector housing. In the preferred example, the six rows are configured in two groups of three rows each. The two groups are separated by slots or openings in the top of the connector housing. The openings are to allow for expansion of the material in the housing and to provide a place for a ground bus, if desired. In another configuration, the space between the two groups of three rows could be used for a seventh row.

BRIEF DESCRIPTION OF THE DRAWINGS

FIG. 6 illustrates a second contact type used in the invention;

FIG. 7 illustrates a guide and mounting pin for aiding the positioning of the connector of FIG. 1 on the circuit board;

FIG. 8 illustrates the connector of FIG. 1 with a mounting and guide cap that is formed on the ends of the connector;

DETAILED DESCRIPTION OF THE INVENTION

Figure 1:
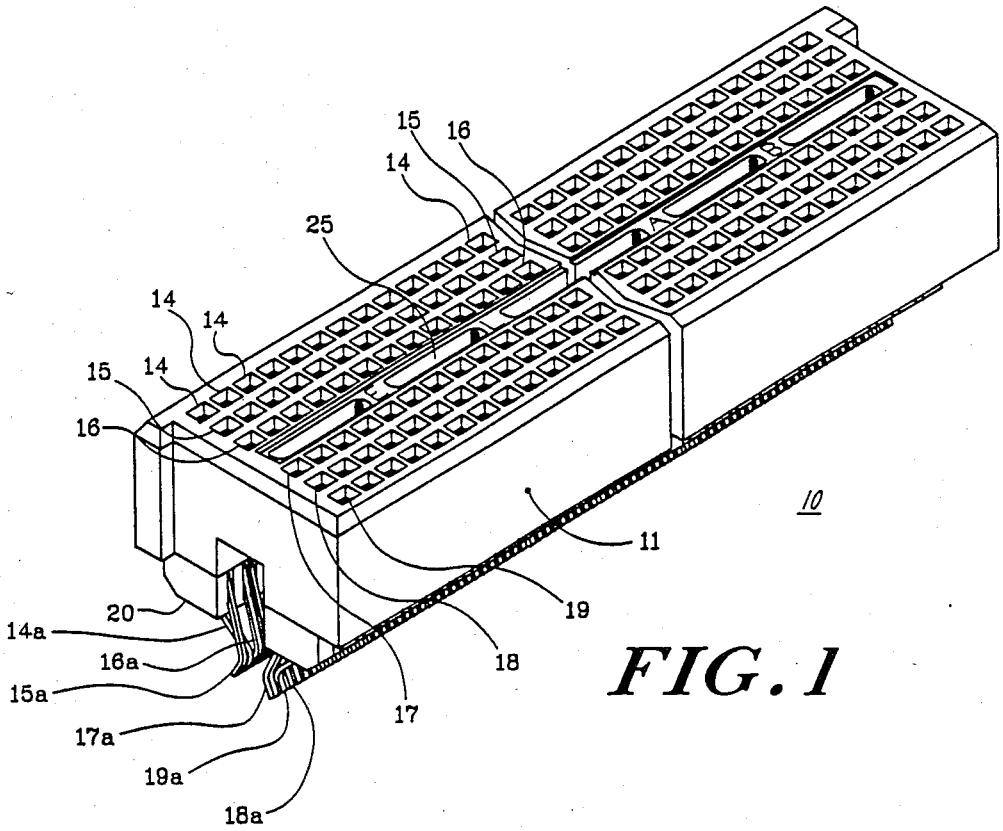
FIG. 1 is a pictorial view of the connector of the present invention.
Figure 2:
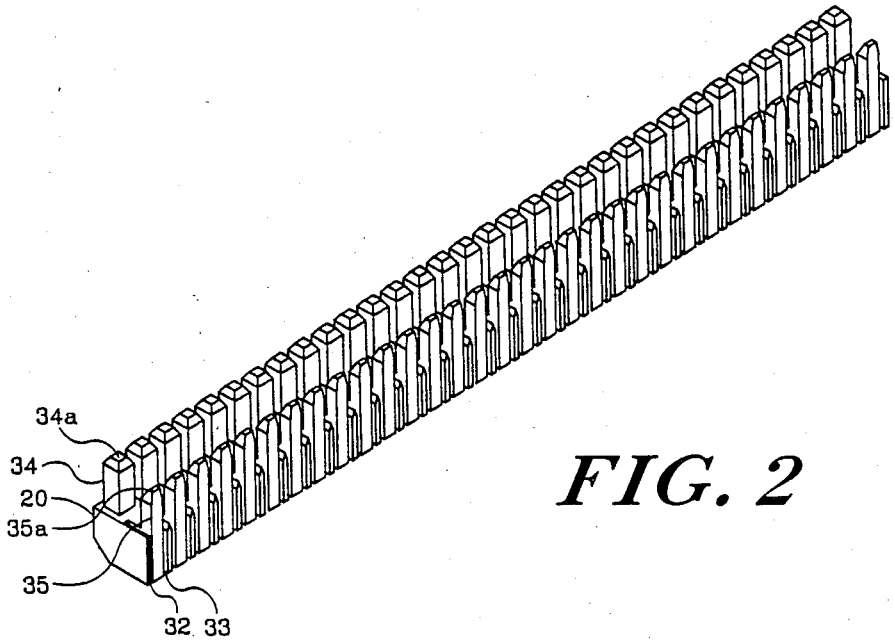
FIG. 2 illustrates a spacing block used to accurately space the ends of the contacts of the connector.

FIG. 1 illustrates one embodiment of the present invention. The connector illustrated is a six row box type connector that is mounted on the edge of a printed circuit board with two rows of contacts surface mounted on the opposite sides of the circuit board. Connector 10 has six rows of contacts 14,15,16,17,18 and 19. Contact ends **14*a*,15*a*,and 16*a* for rows 14,15 and 16 are in line and form a single row A. Similarly, contact ends 17*a*,18*a*, and 19*a* for rows 17, 18 and 19** are in line and form a single row B. The two rows A and B are surface mounted on opposite faces of a circuit board (not shown).

The contacts in the connector may be, for example, spaced 0.1 inch apart in each direction for each three row set. However, since the contact ends for each three row set of connectors are formed in a single row, the contact ends have to be spaced at intervals one-third (0.03333 inch) the distance between the contacts in the connector body. For example, the three row set comprising contacts 14,15 and 16 have the contact ends **14*a*,15*a* and 16*a***.

In FIG. 1, contact ends **14*a* are for the contact ends of the outside row 14, contact ends 15*a* are for the middle row contacts 15 and contact ends 16*a* are for the inside row of contacts 16. The configuration is similar for the other row set of contacts 17,18 and 19. Contact ends 17*a* are for the inside row of contacts 17, contact ends 18*a* are for the middle row of contacts 18, and contact ends 19*a* are for the outer row of contacts 19. Connector 10 has a molded insulator 11 which has a series of openings 25** formed in the insulator between the two sets of contact rows. These openings have a twofold purpose. One purpose is to reduce the mass of material used in the insulator and to provide for expansion to minimize distortion or warping of the insulator. Another purpose is to provide an opening for mounting a grounding buss for the connector, if desired. A seventh row of contacts may also be placed in this central region of the connector modifying the structure of the connector.

To provide the proper spacing for the contact ends of the contacts and to ensure the contact ends are held in place prior to mounting of the connector, a spacing block 20 is used. Two spacing blocks 20 are used, one for each three row set of contacts. The spacing blocks are inserted from the under side of the connector with the contact ends inserted in slots in the spacing block. For example, a contact end 15*a* would be placed in slot 32. A contact end 16*a* would be placed in slot 33. Slots 32 and 33 are separated by post 35 having an end 35*a* which is inserted in a matching opening (see FIG. 4) in insulator 11 and a demi-post 36. Contact end 14*a* extends around the spacing block in slot 37 on the side of the spacing block opposite from spacing slots 32 and 33. Spacing block 20 has a second post 34 with end 34*a* that extends into insulator 11 (see FIG. 4).

Figure 3:
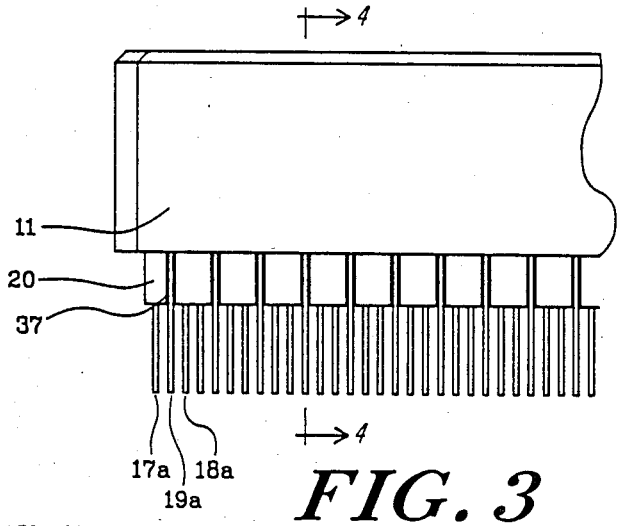
FIG. 3 illustrates a side view (in part) of the connector of FIG. 1.

FIG. 3 is a partial side view of an assembled connector 10. Insulator 11 has spacing blocks inserted with the contacts in place. Contact ends 17*a*, 19*a* and 18*a* are shown in line. Contact end 19*a*, which is the outer contact of the three row set resides in slot 37, slot 37 being on the opposite side of space bar 20 from slots 32 and 33 in which contact ends 17*a* and 18*a* reside.

Figure 4:
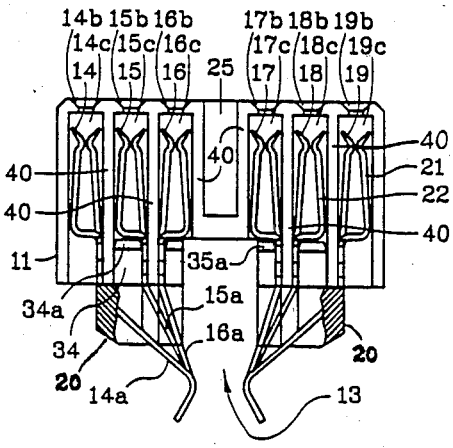
FIG. 4 is a cross section of the connector taken through 4—4 of FIG. 3.

FIG. 4 is a cross sectional view of connector 10 taken as indicated in section 4—4 of FIG. 3. The connector assembly is made up of the insulator 11, two spacing bars 20 and a plurality of contacts arranged in two three row sets for a total of six rows of contacts. The length of the connector is determined by the number of contacts needed.

The contacts are arranged across the connector in the two three row configurations with the opening 25 between the three row sets. When assembled, the connector body 11 and the two spacing bars 20 form a slot 13 into the under side of the connector to provide for inserting a printed circuit board (not illustrated). The contacts are accessed through the top of the connector through the openings 14*b* through 19*b*. Each contact is disposed in a cavity in the insulator 11. For example contact 14 is in cavity 14*c*. Similarly, each contact 14 through 19 is in its respective cavity 14*c* through 19*c*. Each cavity is enclosed by walls 40.

The end of each contact of a three row set is formed to position it in line with the other contact ends of that three row set. Each contact is one of two different configurations of contacts.

Contacts 14 and 19 are formed from one of the two configurations of contacts, and contacts 15 through 18 are formed from the second contact configuration. However, contacts 16 and 17 are formed from the same contact configuration as contacts 15 and 18, but are reversed in the sense that the contact ends are bent in a direction opposite from that of contacts 15 and 18 and the contacts are rotated 180 degrees.

Figure 5:
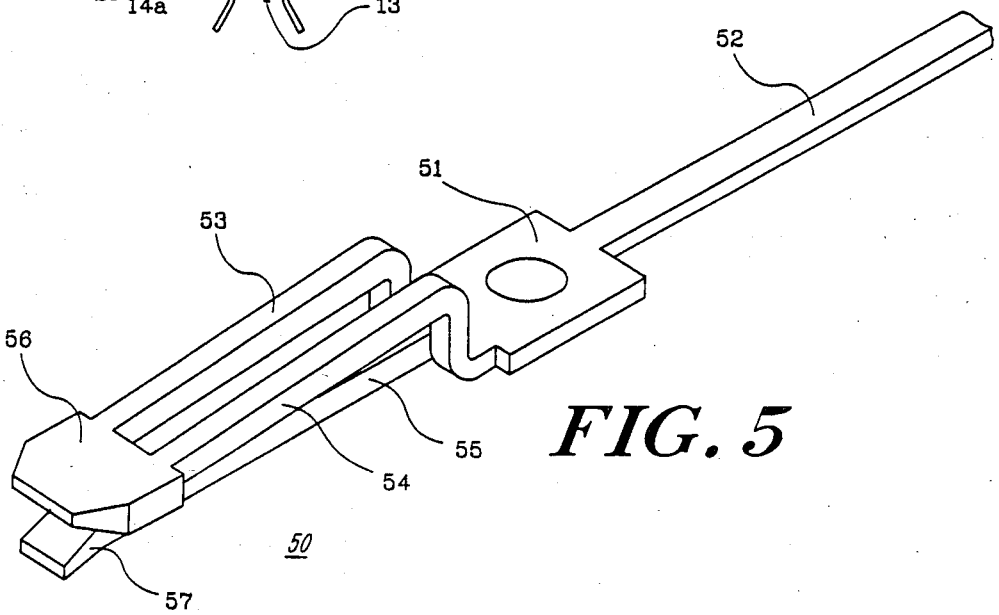
FIG. 5 illustrates one of the contact types used in the invention.

The two configurations of contacts are illustrated in FIGS. 5 and 6. The contact 50 illustrated in FIG. 5 is one of the two configurations of contacts. Contact 50 includes a central portion 51, and a contact end 52 which is centered at one end of the central portion 51. On the other end there are two opposing arms. The arm is made up of two offset members 53 and 54 which are joined together at their ends with contact end 56. The other arm is a single member 55 having a contact end 57. Contact ends 56 and 57 receive the contact from a mating connector.

The contact in FIG. 6 is the second configuration of contacts. The design is the same as the configuration of FIG. 5 except the contact end 62 extends form one side of the central portion 61 rather than being centrally located as is contact end 52 on contact 50. Contact 60 has the contact arms as does contact 50, one arm made up of two members 63 and 65 ending in contact end 66 and contact arm 64 ending in contact end 67. By rotating contact 60 180 degrees around its longitudinal axis the contact end is effectively placed on the opposite side of the central portion 61. By rotating the contact configuration of FIG. 6, the in line configuration of the contact ends of the contacts in each three row set is achieved by usign only two configurations of contacts.

FIG. 7 illustrates a pin 100 used to position the connector of the present invention over the contact pads on the circuit boards and to secure the connector to the printed circuit board. The pin has a central region 101 that is pressed and/or secured in the printed circuit board with the ends 102 and 103 extending out opposite sides of the printed circuit board. FIG. 8 illustrates a connector 110 with a mounting cap 117 on the end. While only one end of the connector is illustrated, there will be a mounting cap on each end of the connector. The mounting cap 117 has parallel parts 113 and 114 separated by the opening 115. When the connector is positioned on a printed circuit board, the parallel parts 113 and 114 are on opposite sides of the circuit board with the board extending into opening 115. The pins 100 are positioned so that when the connector is moved on to the printed circuit board with the board extending into the opening 115, the ends of the pin 102 and 103 move into the opening 115 against the sides 120 and 121 of the mounting cap and stop so that the pin is aligned with the opening 116 of the mounting cap. With use of a pin 100 at each end of the connector, the contact terminals 112, properly positioned by the spacing block 111, are positioned over the contact pattern on the printed circuit board, as illustrated in FIGS. 9 and 10.

After the connector is in place screws may be used to secure the connector in place using opening 104 in pin 100. The opening may be threaded or a screw may extend through the pin 100 and the circuit board.

Figure 9:
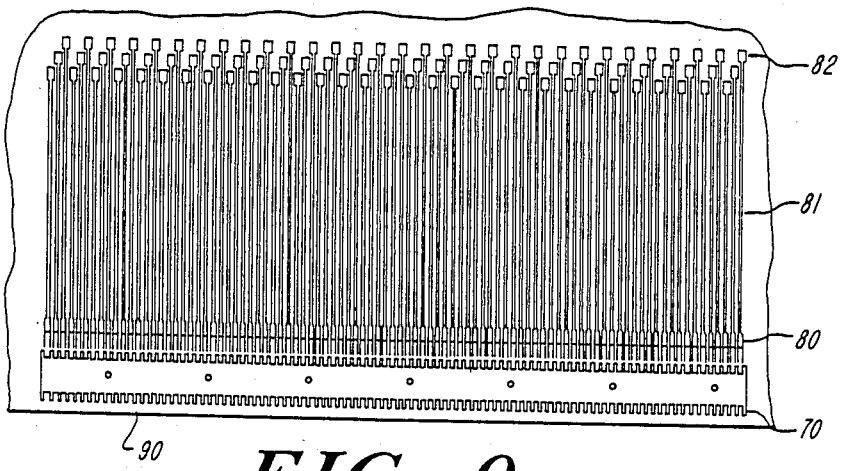
FIG. 9 illustrates a contact pattern for use with the connector of the present invention.
Figure 10:
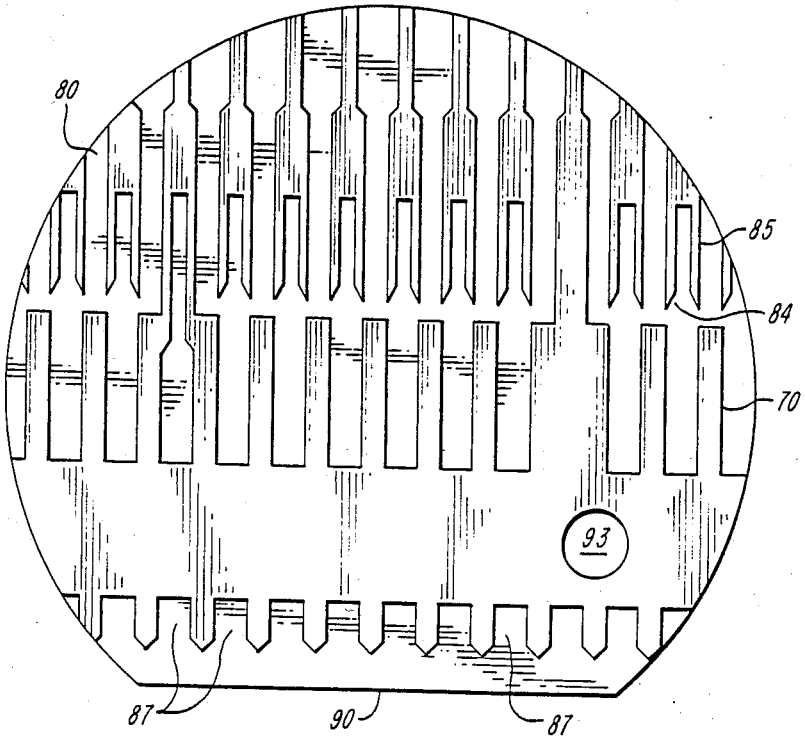
FIG. 10 is a detailed and enlarged view of a part of the contact pattern of FIG. 9.

FIG. 9 is a contact pattern on a printed circuit board that may be used with the connector of the present invention, and includes a pattern separate from the contact pattern to guide the contacts of the connector on to contact pads 80 and to accurately position each contact of the connector.

The circuit pattern includes guide patterns 70 and contact pads 80 connected to circuit leads 81 and other connection pads 82.

FIG. 10 illustrates a detailed and enlarged view of the contact guide and contact pad. A plurality of guide patterns 70 extend along and vertical to the edge 90 of the circuit board to which the connector is to be mounted on and connected therewith. The guide patterns 70 form tracks 87 between pairs of guide patterns. As a connector is mounted on the circuit board, each contact end is placed between guide patterns and on the tracks 87. As the connector is moved to position the contact ends of the connector to circuit pads 80, each contact end is guided along its respective track to a position between the guides of each contact pad 80, there being two guides 84 and 85 for each contact. With further movement of the connector, each contact end is moved into the space between the contact guides 84 and 85 to engage the contact end with its respective contact pad 80. There is a contact pad and guide pattern on each side of the printed circuit board to facilitate placement of both rows of contacts ends A and B for each connector.

While the invention has been described with reference to a preferred embodiment, it is to be understood that various changes and modifications may be made by those skilled in the art without departing from the spirit and scope of the invention.

What is claimed is:

1. A multi row connector adapted for electrical connection to contact pads disposed on opposed sides of one edge of a printed circuit board, comprising:

an insulator having an underside, a central region and first and second sets of contact cavities formed therein in symmetrical disposition about said central region of said insulator, and wherein each of said first and second sets of contact cavities are formed as plural rows of contact cavities in symmetrical disposition about said central region;

a first and second plurality of contacts disposed in said plural rows of contact cavities of said first and second sets, respectively, and wherein said first and second plurality of contacts include contact ends extending out from said underside of said insulator, said contacts ends of said first and second plurality of contacts adapted for surface mounting to the contact pads disposed on the opposed sides of the one edge of the printed circuit board;

a first spacing block disposed adjacent said underside of said insulator coacting with said contact ends of said first plurality of contacts to properly space and position said contact ends of said first plurality of contacts in a single row for surface mounting to the contact pads disposed on one side of the one edge of the printed circuit board; and a second spacing block disposed adjacent said underside of said insulator coacting with said contact ends of said second plurality of contacts to properly space and position said contact ends of said second plurality of contacts in a single row for surface mounting to the contact pads disposed on the opposed side of the one edge of the printed circuit board, and wherein said first and second spacing blocks in combination with said insulator form a slot adjacent said underside of said insulator for insertion of the printed circuit board.

2. The mutli row connector of claim 1 wherein each said first and second spacing blocks has a plurality of grooves formed in opposed sides thereof for coactively receiving said contact ends of said first and second plurality of contacts, respectively, and wherein said plurality of grooves are formed in said opposed sides of each said first and second spacing blocks in a ratio of two to one, and further wherein said contact ends of said first and second plurality of contacts are spaced and positioned in said plurality of grooves to form said single rows.

3. The multi row connector of claim 1 wherein said insulator has a series of openings formed in the side of said insulator in opposed relation to said underside, and wherein said series of openings are formed in said central region between said first and second sets of contact cavities.

4. The multi row connector of claim 1 wherein said contact ends of said first and second plurality of contacts are spaced to hold said multi row connector to the printed circuit board inserted in said slot formed by said first and second spacing blocks in combination with said insulator.

5. The multi row connector of claim 1 wherein each of said plural rows of contact cavities of each said first and second sets of contact cavities is equidistantly spaced a predetermined distance from each adjacent row of contact cavities, and wherein each of said plural rows of contact cavities has individual contact cavities equidistantly spaced said predetermined distance from each adjacent contact cavity.

6. The multi row connector of claim 5 wherein each of said contact ends of said first and second plurality of contacts is spaced one-third of said predetermined distance from each adjacent contact end.

7. The multi row connector of claim 1 wherein each said first and second plurality of contacts further comprise first, second and third sets of contacts and wherein said first, second and third sets of contacts are disposed in said first and second sets of contact cavities to coact with said first and second spacing blocks, respectively, to form said single rows of contact ends for surface mounting to the contact pads disposed on the opposed sides of the one edge of the printed circuit board.

8. The multi row connector of claim 7 wherein each contact of said first, second and third sets of contacts further comprises a central portion having a longitudinal axis and first and second ends at opposed ends of the longitudinal axis, a contact end extending longitudinally from said first end of said central portion, and opposing contact arms extending longitudianlly from said second end of said central portion, and wherein each of said first set of contacts have said contact end extending centrally from said first end of said central portion and each of said second and third set of contacts have said contact end extending off-centrally from said first end of said central portion, and further wherein each of said third set of contacts are rotated 180° about the longitudinal axis thereof prior to disposition in said first and second sets of contact cavities.

9. The multi row connector of claim 8 wherein each of said first and second spacing blocks has a first and second plurality of grooves formed in a side thereof facing said slot and a third plurality of grooves formed in a side thereof opposed to said side facing said slot, and wherein said second and third sets of contacts are disposed in respective ones of said first and second plurality of grooves and said first set of contacts is disposed in respective ones of said third plurality of grooves.

10. The multi row connector of claim 1 further comprising first and second mounting caps disposed on opposed ends of said insulator, and wherein each of said first and second mounting caps has an opening formed therein to receive the printed circuit board disposed in said slot formed by said first and second spacing blocks in combination with said insulator.

11. The multi row connector of claim 10 further comprising first and second mounting pins, said first and second mounting pins coacting with said first and second mounting caps, respectively, to position said multi-row connector on the printed circuit board wherein said single rows of said contact ends of said first and second plurality of contacts are aligned for surface mounting to the contact pads disposed on the opposed sides of the one edge of the printed circuit board.

12. A multi row connector adapted for electrical connection to contact pads disposed on opposed sides of one edge of a printed circuit board, comprising;

an insulator having a central region and a plurality of rows of contact cavities symmetrically disposed about said central region, said insulator further including an underside having a first and second plurality of post-receiving openings formed therein on each side of said central region;

a first and second spacing block, each of said first and second spacing blocks having a first and second plurality of posts depending therefrom for insertion into respective ones of said first and second plurality of post-receiving openings to dispose said first and second spacing blocks adjacent said underside of said insulator, said first and second spacing blocks in combination forming a slot adjacent said underside of said insulator for insertion of the printed circuit board, and wherein each said first and second spacing blocks has a first and second plurality of grooves formed in a side facing said slot and a third plurality of grooves formed in the side opposed to the side facing said slot;

a first plurality of contacts disposed in respective rows of said plurality of rows of contact cavities symmetrically about said central region, said first plurality of contacts having contact ends disposed in said third plurality of grooves of said first and second spacing blocks;

a second plurality of contacts disposed in respective rows of said plurality of rows of contact cavities symmetrically about said central region, said second plurality of contacts having contact ends disposed in said first plurality of grooves of said first and second spacing blocks; and a third plurality of contacts disposed in respective rows of said plurality of rows of contact cavities symmetrically about said central region, said third plurality of contacts having contact ends disposed in said second plurality of grooves of said first and second spacing blocks; and wherein said contact ends of said first, second and third plurality of contacts disposed in said third, first and second plurality of grooves of said first and second spacing blocks, respectively, form a single row of contact ends associated with each said first and second spacing blocks for surface mounting to the contact pads disposed on the opposed sides of the one edge of the printed circuit board.

* * * * *